US007381156B2

(12) United States Patent
Silagy

(10) Patent No.: US 7,381,156 B2
(45) Date of Patent: Jun. 3, 2008

(54) EXERCISE DEVICE

(76) Inventor: Robert Silagy, 7 Hawthorne Ave., Merrick, NY (US) 11566

( * ) Notice: Subject to any disclaimer, the term of this patent is extended or adjusted under 35 U.S.C. 154(b) by 0 days.

(21) Appl. No.: 11/227,561

(22) Filed: Sep. 15, 2005

(65) Prior Publication Data

US 2007/0060448 A1 Mar. 15, 2007

(51) Int. Cl.
*A63B 23/16* (2006.01)
*A63B 21/02* (2006.01)

(52) U.S. Cl. ..... 482/47; 482/44; 482/122

(58) Field of Classification Search ..... 482/44–50, 482/121, 122, 124, 129; D21/684; 601/33, 601/40, 135
See application file for complete search history.

(56) References Cited

U.S. PATENT DOCUMENTS

| | | | | |
|---|---|---|---|---|
| 623,592 | A | 4/1899 | Bonney | |
| 897,471 | A | 9/1908 | Loyola | |
| 2,634,976 | A | 4/1953 | Mock | |
| 3,129,939 | A * | 4/1964 | Stock | 482/49 |
| 3,606,316 | A * | 9/1971 | Krewer | 482/47 |
| 3,612,521 | A | 10/1971 | Wendeborn | |
| 4,105,200 | A * | 8/1978 | Unger | 482/44 |
| 4,711,445 | A * | 12/1987 | Whitehead | 482/49 |
| 4,730,827 | A * | 3/1988 | Williams | 482/47 |
| 4,815,729 | A | 3/1989 | Stefanski | |
| 4,828,249 | A | 5/1989 | Keating | |
| 4,875,469 | A | 10/1989 | Brook et al. | |
| 5,013,030 | A | 5/1991 | Frins | |
| 5,062,625 | A | 11/1991 | Vonk | |
| 5,076,569 | A * | 12/1991 | Gootter | 482/49 |
| 5,136,911 | A | 8/1992 | Wyss | |
| 5,366,436 | A | 11/1994 | Gibney | |
| 5,403,008 | A * | 4/1995 | Mainiero | 473/201 |
| 5,447,490 | A | 9/1995 | Fula et al. | |
| 5,492,525 | A | 2/1996 | Gibney | |
| 5,514,052 | A | 5/1996 | Charles et al. | |
| 5,613,923 | A | 3/1997 | Anliker | |
| 5,806,091 | A * | 9/1998 | McHugh | 2/20 |
| 5,820,522 | A * | 10/1998 | Smallwood et al. | 482/49 |
| 5,820,577 | A | 10/1998 | Taylor | |
| 5,945,060 | A * | 8/1999 | Williams | 264/564 |
| 5,954,060 | A * | 9/1999 | Cardarelli | 131/360 |
| 6,179,751 | B1 | 1/2001 | Clears | |
| 6,213,918 | B1 | 4/2001 | Rogers, Jr. | |
| 6,228,001 | B1 | 5/2001 | Johnson et al. | |
| 6,692,415 | B1 * | 2/2004 | Winston | 482/126 |
| 6,770,011 | B1 * | 8/2004 | Hinds | 482/44 |
| 6,817,967 | B1 | 11/2004 | Ott et al. | |

OTHER PUBLICATIONS

International Search Report from International Application No. PCT/US06/035677 dated Jan. 7, 2007.

* cited by examiner

*Primary Examiner*—Fenn C. Mathew
*Assistant Examiner*—Allana Lewin
(74) *Attorney, Agent, or Firm*—Carter, DeLuca, Farrell & Schmidt, LLP

(57) ABSTRACT

An exercise device includes a body having at least one recess formed therein, the recess being configured and dimensioned to receive a finger of a user, and an elastic member removably disposed around a periphery of the body.

2 Claims, 4 Drawing Sheets

EXERCISE DEVICE

TECHNICAL FIELD

The present disclosure relates to an exercise device for the hand and fingers. More particularly, an exercise device that provides resistance against extension of a user's fingers is described.

BACKGROUND OF RELATED ART

Routines contemplating the exercising of fingers by flexing the fingers against the resistance of springs are frequently used to strengthen the fingers or hand, for example, in physical therapy regimens. One commercially available device for such routines is the DIGI-FLEX® line of products. (DIGI-FLEX® is a registered trademark of IMC Products Corp., Hicksville, N.Y.) The DIGI-FLEX® products provide an exerciser having different extents of resistance to individual finger exercise and entire hand exercise, wherein the latter is not merely the cumulative resistance of the former, so that the resistance is a function of the strength of the user in the selected exercise mode, and correspondingly provides maximum exercising benefit to the user. See, e.g., U.S. Pat. No. 5,147,256.

Devices that provide resistance against extension of the fingers (as opposed to flexure of the fingers) have also been used for exercising the fingers and/or hand. Devices of this type are exemplified, for example, in U.S. Pat. Nos. 623,592; 3,612,521; 4,828,249; 4,875,469; 5,013,030; 5,062,625; 5,366,436; 5,447,490; 5,492,525; 5,514,052; 5,613,923; 5,820,577; 6,179,751; 6,213,918; 6,817,967; and 6,288,001. There remains a need for a simple device that provide resistance against extension of the fingers, wherein the degree of resistance can be easily increased or decreased, depending on the desired exercise regimen.

SUMMARY

An exercise device in accordance with the present disclosure includes a body having at least one recess formed therein, the recess being configured and dimensioned to receive a finger of a user, and an elastic member removably disposed around a periphery of the body. In particularly useful embodiments, the exercise device includes a plurality of recesses formed therein, each of the plurality of recesses being configured and dimensioned to receive each finger on one hand of a user. Optionally, the exercise device further includes a pair of guides flanking one or more of the recesses, the pair of guides having a first end secured to the body and a second end spaced apart from the body to allow removal of the elastic member form the periphery of the body.

DETAILED DESCRIPTION

Figure 1:
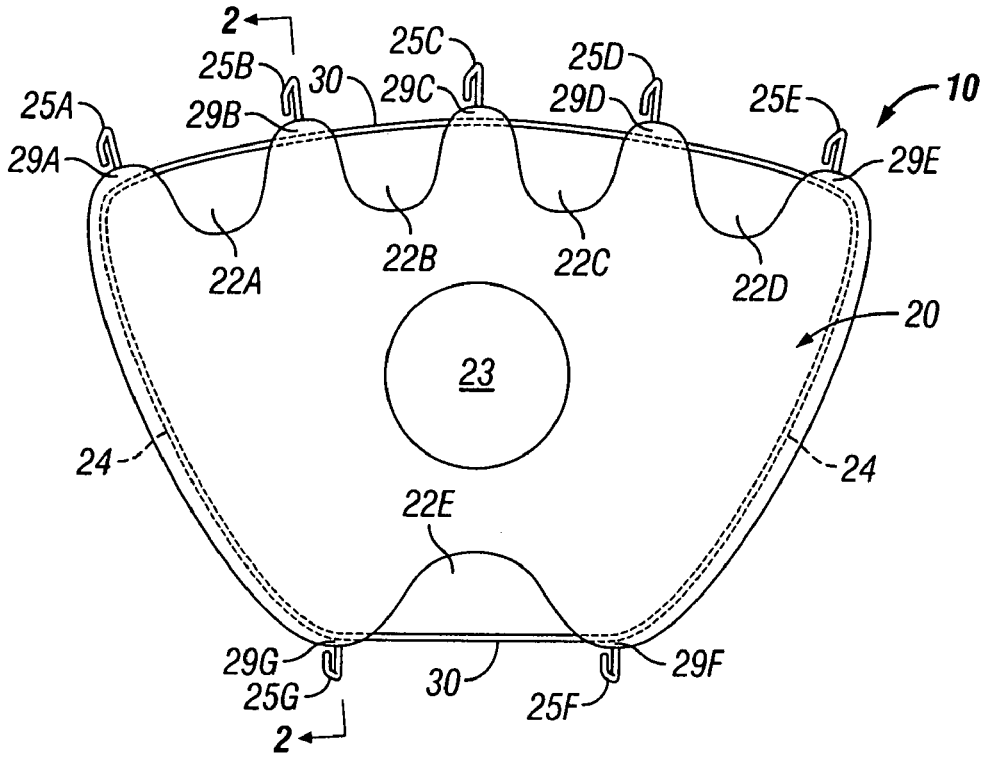
FIG. 1 is a plan view of an exercise device in accordance with one embodiment of the present disclosure.
Figure 2:
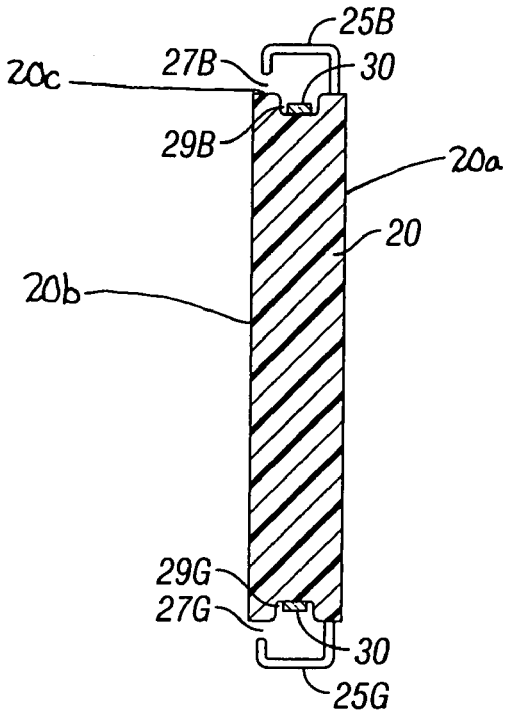
FIG. 2 is a cross sectional view of the embodiment of FIG. 1 through line 2-2'.

The description of the embodiments which follows, together with the accompanying drawings should not be construed as limiting the invention to the example shown and described, because those skilled in the art to which this disclosure pertains will be able to devise other forms thereof within the ambit of the appended claims. As seen in FIG. 1, an exercise unit 10 includes a body 20, and a removable elastic member 30 extending around the periphery of body 20. Body 20 includes a top surface 20*a*, a bottom surface 20*b* and a sidewall 20*c* extending between the top and bottom surfaces. See FIG. 2.

Body 20 has recesses 22A though 22E configured and dimensioned to receive each of the five fingers of a user (not shown). A central opening 23 can optionally be provided as an alternative location for positioning the user's thumb (not shown) during exercising. A groove for receiving elastic member 30 can optionally be provided wherever elastic member 30 contacts the periphery of body 20, such as, for example, grooves 29A through 29G located under each corresponding guide 25A-G (see FIG. 1), and grooves 24 along the sides of body 20. The material of construction of body 20 is not critical. Body 20 can be made, for example, form plastic, rubber, metal, ceramic, wood, or the like. The manner of construction of body 20 is likewise not critical. Body 20 can be molded, cast, stamped, carved, or formed using any other technique. Body 20 can be a unitary structure or can be made from two or more pieces that are, for example, snap fit together. In embodiments, body 20 is a unitary structure that is molded or cast from a latex-free synthetic material. One illustrative material for forming body 20 is commercially available under the tradename SANTOPRENE® from Advanced Elastomer Systems, L.P., Akron, Ohio.

Guides 25A through 25G are positioned adjacent each corresponding recess 22A through E. Guides 25A-G are attached at one end to body 20 and are spaced from body 20 at the other end. Spaces 27A through 27G allow insertion and removal of elastic member 30. Guides 25A-G can be made from any material, including but not limited to the materials listed above from which body 20 can be made. Guides 25A-G can be formed as a unitary structure with body 20. For example, the guides can be molded from the same material as is used to mold body 20. Alternatively, guides 25A-G can be made from a material different from the material form which body 20 is made and secured to or embedded within body 20. In embodiments, guides 25A-G are made from stainless steel and are threaded into body 20. In other embodiments, guides 25A-G are placed partially within a mold and body 20 is molded around a portion of guides 25A-G to embed the guides within body 20. Those skilled in the art will readily envision other techniques for connecting guides 25A-G to body 20. It should of course be understood that a lesser number of guides can effectively be employed in exercise unit 10.

Elastic member 30 is positioned around the periphery of body 20. Elastic member 30 is, essentially, a rubber band that serves as a means of providing resistance during exercise. Elastic member 30 has a degree of elasticity that provides resistance within a range desirable for finger/hand exercise and can undergo a number of stretchings, while repeatedly reassuming its original unstretched configuration upon release of the stretching force. While elastic member 30 can be made from latex or natural rubber, in certain embodiments elastic member 30 can advantageously be made from non-allergenic synthetic elastomers. Such materials are known to those skilled in the art. In certain embodiments, thermoplastic elastomers suitable for forming elastic member 30 are capable of being extruded in the form of very thin films, particularly from about 0.1 mm to 1.25 mm thick and can have an elongation to break of about 300% to about 900%, a tensile strength of about 10 to about 30 MPa, and a modulus at 300% elongation of about 1 to 5 MPa. Illustrative examples of such thermoplastic elastomers include styrene-butadiene-styrene block copolymers, styrene-ethylenelbutylene-styrene block copolymers (SEBS) such as the type commonly available under the tradename KRATON® available from Kraton Polymers U.S. LLC, Houston Tex. Also useful in forming elastic member 30 are polyolefin elastomers such as the type sold under the tradename ENGAGE® by DuPont Dow Elastomers, L.L.C., Wilmington, Del. (See generally, U.S. Pat. No. 5,945,060, the entire disclosure of which is incorporated herein by this reference.) Other suitable materials for forming elastic member 30 will be apparent to those skilled in the art.

As noted above, elastic member 30 can be removed from body 20. This permits one elastic member 30 to be replaced with another elastic member having different resistive force. In this manner, each individual user can begin his/her exercise regimen at the appropriate level of resistance and progressively increase the intensity of the exercise by increasing the resistance level of the elastic member.

Elastic members 30 thus advantageously can be provided in a variety of thicknesses, with different thicknesses of material providing different degrees of resistance. In this way, an elastic member can be pre-selected to provide a desired degree of resistance. Alternatively, the composition of the elastic member and/or the production parameters can be selected to produce elastic members of varying levels of resistance.

Furthermore, coloring matter can be provided during manufacture to produce colored elastic members. Different colors can be indicative of different levels of resistance. In one illustrative coloring scheme, a yellow elastic member would indicate a low level of resistance, with red, green, blue and black indicating progressively greater levels of resistance.

Optionally, the elastic members can also be printed or otherwise patterned with informational or aesthetic ornamentation. For example, one or both surfaces of elastic member 30 can be textured, such as by embossing them using a textured plate. Such texturing can be purely functional (e.g., to provide a more grippable surface) or the texturing can also serve informational purposes (e.g., printed with indicia indicating the number of pounds of resistance which it provides) and/or aesthetic purposes.

Figure 3A:
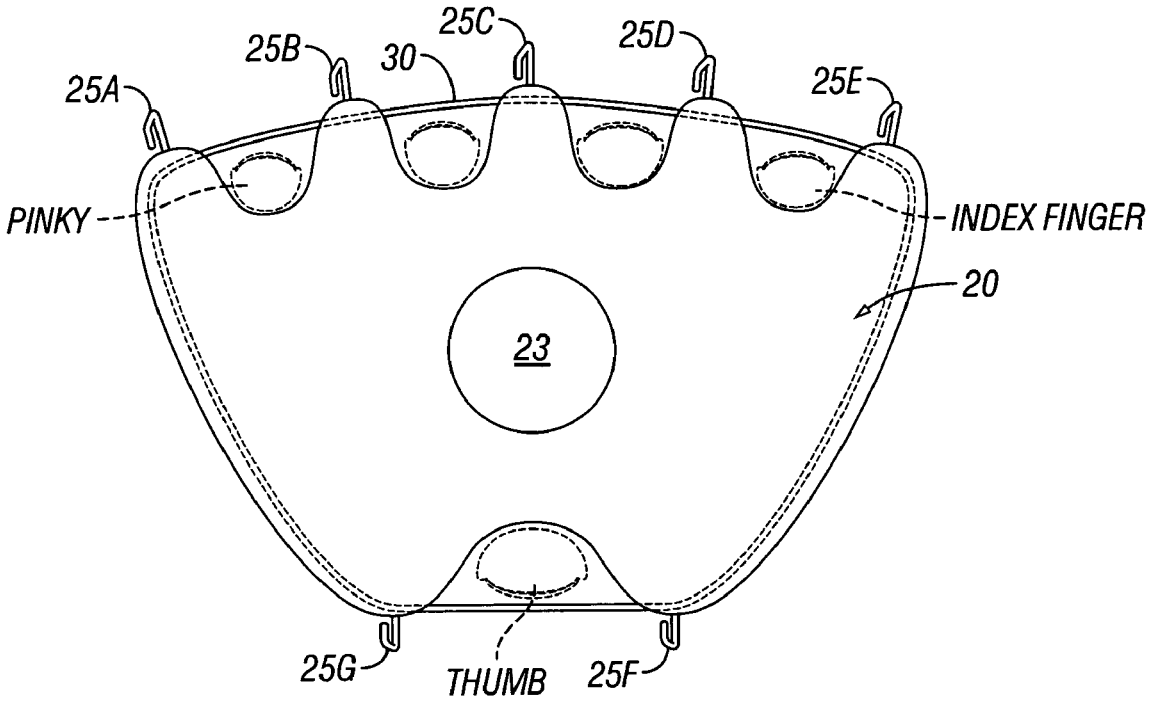
FIGS. 3A-D show the manner of use of the embodiment of FIG. 1.
Figure 3B:
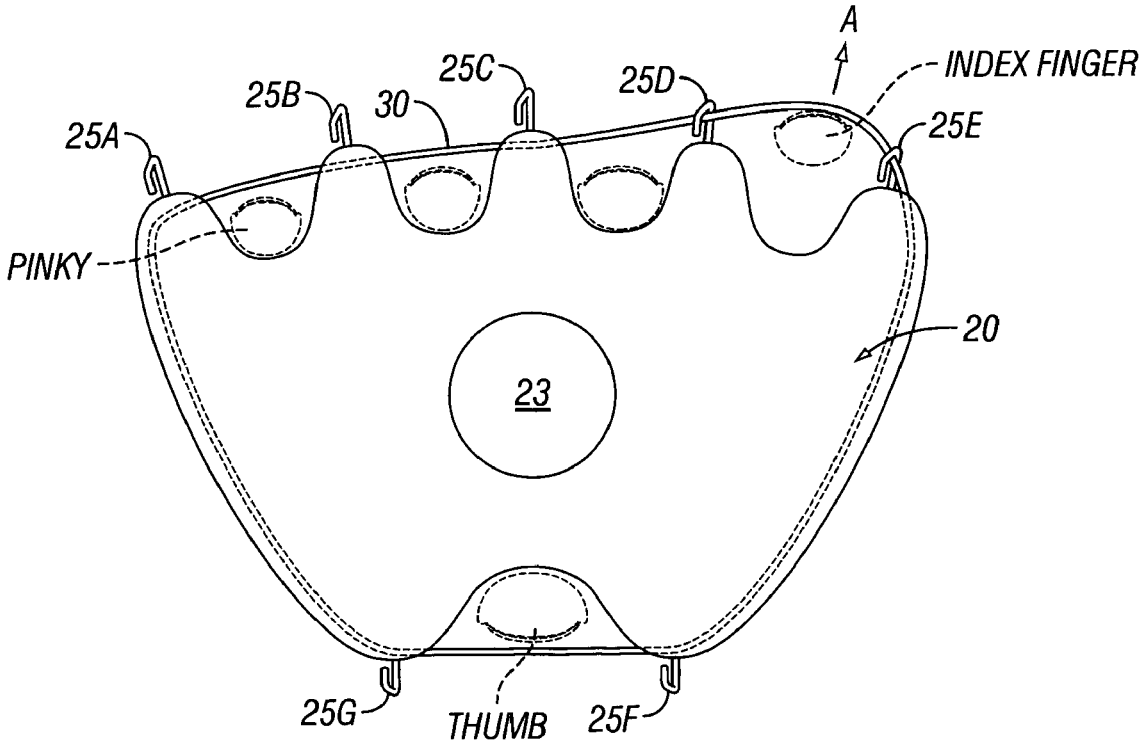
Figure 3C:
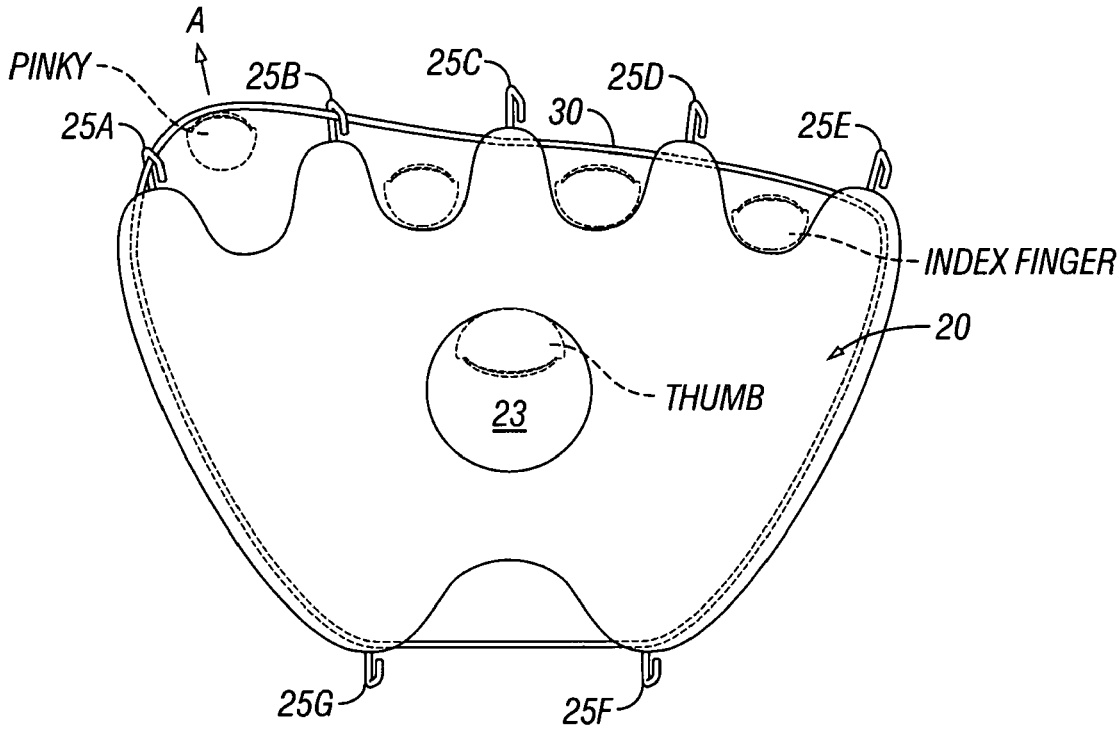
Figure 3D:
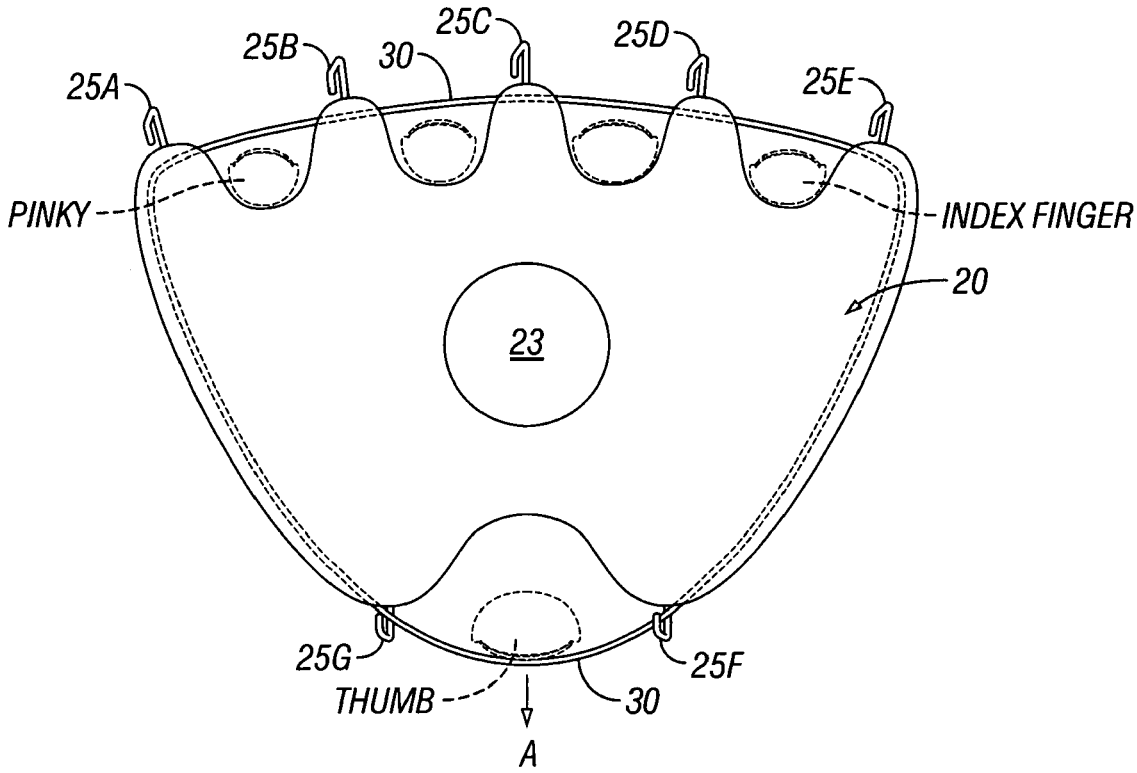

FIGS. 3A-D show the manner of use of exercise device 10. Initially, as shown in FIG. 3A, user places each finger within a recess 22A-E, between elastic member 30 and body 20. The user then moves one or more fingers in a direction away from body 20 to stretch elastic member 30. For example, as shown in FIG. 3B, the user can move his/her index finger in the direction of arrow "A" while maintaining all other fingers against body 20. As another example, shown in FIG. 3C, the user can move his/her pinky in the direction of arrow "A" while maintaining all other fingers against body 20. It should be noted that in FIG. 3C, the user's thumb is positioned in optional opening 23 rather in recess 22E. As yet another example, shown in FIG. 3D, the user can move his/her thumb in the direction of arrow "A" while maintaining all other fingers against body 20. It should of course be understood that the user may move two or more fingers simultaneously in a direction away from body 20 to exercise two or more fingers simultaneously.

Once a user has exercised sufficiently to stretch an elastic member of a particular resistance, the elastic member can be easily removed from the periphery of body 20 by sliding elastic member 30 out from under guides 25A-G and can be replaced with an elastic member of higher or lower resistance.

Figure 4:
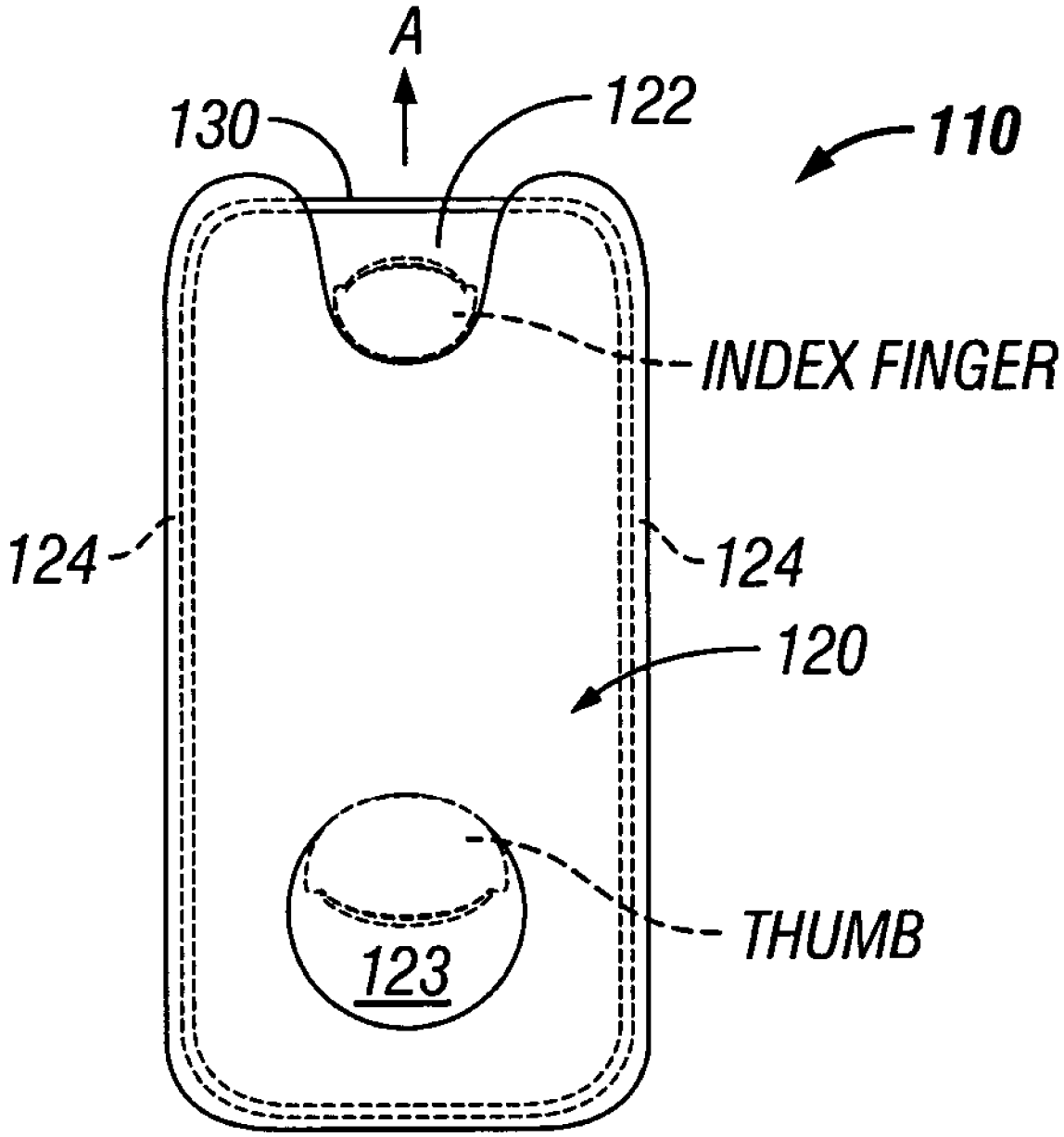
FIG. 4 shows an alternative embodiment of an exercise device in accordance with this disclosure adapted for exercising a single finger at a time.

FIG. 4 shows an alternative embodiment of an exercise device in accordance with this disclosure adapted for exercising a single finger at a time. In this embodiment exercise device 110 includes body 120 and elastic member 130 positioned around the periphery thereof. Body 120 includes a recess configured and dimensioned for receiving a finger of a user and an opening 123 for dimensioned and configure for receiving the thumb of a user. A groove 124 for receiving elastic member 30 can optionally be provided where elastic member 130 contacts the periphery of body 120. In use, a user places one finger recess 122, between elastic member 130 and body 120. The user then moves the finger in a direction away from body 120 to stretch elastic member 130. For example, as shown in FIG. 4, the user can move his/her index finger in the direction of arrow "A" while maintaining his/her thumb in opening 123.

It will be understood that various modifications may be made to the embodiments disclosed herein. Therefore, the above description should not be construed as limiting, but merely as exemplifications of preferred embodiments. Those skilled in art will envision other modifications within the scope and spirit of the claims appended hereto.

I claim:

1. An exercise device comprising:

a body having a top surface, a bottom surface and a sidewall extending about the top and bottom surfaces between the top and bottom surfaces, the sidewall including at least one recess formed therein;

an elastic member positioned about the periphery of the body, the elastic member extending across the at least one recess to enclose the at least one recess such that the enclosed recess is dimensioned and configured to receive a finger of a user; and a shallow groove extending along the sidewall of the body, the shallow groove being dimensioned to receive the elastic member.

2. An exercise device as in claim 1, wherein the at least one recess includes a plurality of recesses, the elastic member extending across each of the recesses.

* * * * *